US006343981B1

(12) United States Patent
Buchanan

(10) Patent No.: US 6,343,981 B1
(45) Date of Patent: Feb. 5, 2002

(54) VEHICLE FOR SCRAPING A FLOOR

(76) Inventor: Max F. Buchanan, 232 Cool Stone Bend, Lake in the Hills, IL (US) 60102

( * ) Notice: Subject to any disclaimer, the term of this patent is extended or adjusted under 35 U.S.C. 154(b) by 0 days.

(21) Appl. No.: 09/730,239

(22) Filed: Dec. 5, 2000

(51) Int. Cl.[7] ..... B32B 35/00
(52) U.S. Cl. ..... 451/350; 156/584; 299/37.1
(58) Field of Search ..... 451/350, 353; 299/36.1, 37.1, 93.1, 37.2; 15/93.1, 256.5, 584

(56) References Cited

U.S. PATENT DOCUMENTS

| | | | | | |
|---|---|---|---|---|---|
| 2,519,138 | A | * | 8/1950 | Katz | 262/8 |
| 4,668,017 | A | * | 5/1987 | Peterson et al. | 299/37 |
| 4,797,025 | A | * | 1/1989 | Kennedy | 451/353 X |
| 5,002,629 | A | | 3/1991 | Nakamura | 2/59 |
| 5,082,330 | A | | 1/1992 | Holder | 1/44 |
| 5,092,658 | A | * | 3/1992 | Smith | 451/353 X |
| 5,197,784 | A | | 3/1993 | Holder | 2/19 |
| 5,641,206 | A | | 6/1997 | Craft | 5/45 |
| 5,702,161 | A | | 12/1997 | Finney et al. | 2/16 |
| 5,713,637 | A | | 2/1998 | Worden et al. | 5/53 |
| 5,772,284 | A | | 6/1998 | Lindsey et al. | 4/41 |
| 5,829,534 | A | | 11/1998 | Easton et al. | 3/26 |
| 5,830,313 | A | | 11/1998 | Smith | 4/50 |
| 5,885,139 | A | | 3/1999 | Lemieux et al. | 2/26 |
| 6,092,876 | A | * | 7/2000 | Arbucci | 299/37.1 |
| 6,135,566 | A | * | 10/2000 | Anderson | 299/37.1 |
| 6,264,282 | B1 | * | 7/2001 | Gaumont | 299/36.1 |

* cited by examiner

*Primary Examiner*—Joseph J. Hail, III
*Assistant Examiner*—Anthony Ojini
(74) *Attorney, Agent, or Firm*—Mathew R. P. Perrone, Jr.

(57) ABSTRACT

A vehicle for scraping a floor has an adjustable blade with various widths mountable thereon and is an appropriate vehicle size for moving through a standard door.

18 Claims, 6 Drawing Sheets

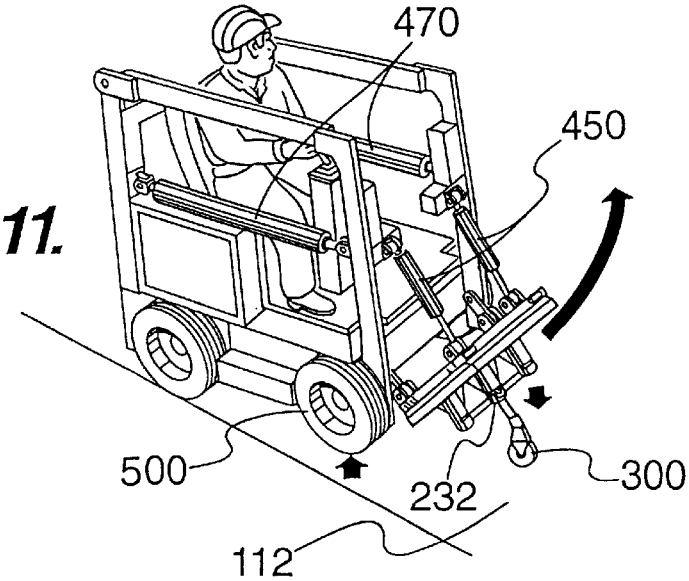
Fig.11.
Fig.12.
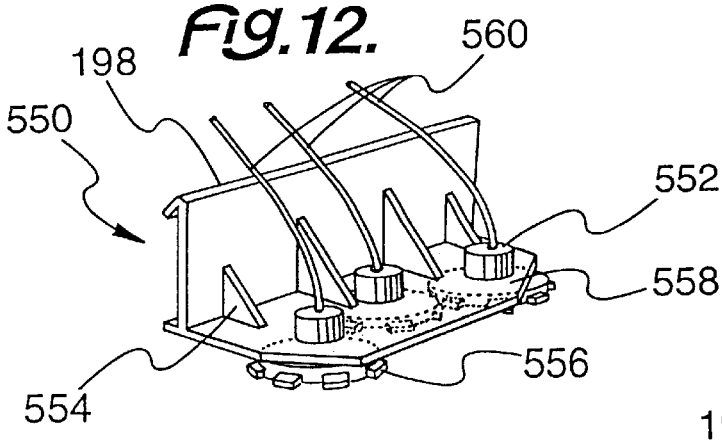
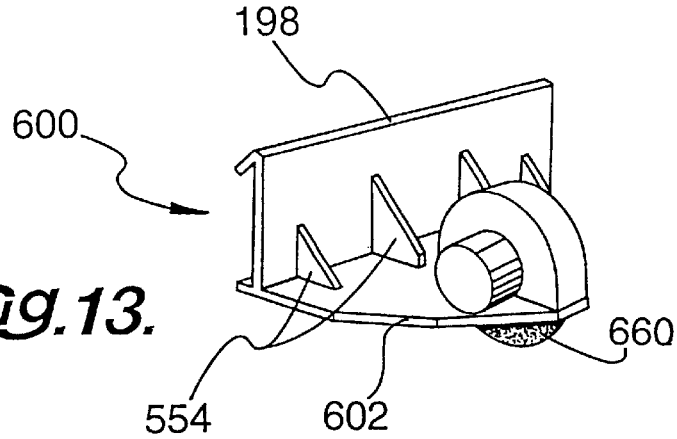
Fig.13.

VEHICLE FOR SCRAPING A FLOOR

BACKGROUND OF THE INVENTION

Removing floor covering material affixed to an underlying floor can be a tedious task. Several floor covering removal machines are known. Of these prior art machines, several are large machines ridden by an operator. Some other machines are significantly less in weight than others, for which the operator walks behind the machine.

Several types of machines exist on the market for removing tile, carpeting, or other coverings from a floor. There are also machines specially designed for resurfacing floors. However, there does not seem to be any machine which can combine the two operations.

Also, in each known floor covering, scraping or removing machine; there is an absence of a machine counterbalancing system to adjust the bias of the scraping element against the floor. Such a bias adjustment permits more efficient use of the machine and work.

A problem with the riding machines is that their size makes them difficult to use and maneuver in indoor areas. For example, such riding machines are too large to pass through a standard door. An advantage is that the large machines are able to generate large forces for stripping the floor covering.

A problem with the lighter weight, walk-behind machines is that they do not generate as much power for stripping floor covering, and thus are less effective at stripping tiles and carpeting secured by adhesives or epoxies. An advantage of the walk-behind machines is that they are smaller, can fit into smaller areas, and are more maneuverable than the larger machines.

Accordingly, there is a need for a floor covering removal machine, which has the power of the larger riding machines, without having the disadvantages of the large size and comparatively poorer maneuverability, especially for indoor use. The scraping capabilities of that machine must also be maintained.

Motor or hand-propelled devices for removing covering from horizontal surfaces such as floors and decks are well known. These devices typically include a blade which is wedged between the supporting surface and the covering to be removed. As the apparatus moves forward, the blade strips the covering from the surface. The lack of capability for the apparatus to adjust to irregularities in the contour of the surface adversely influences the efficiency of covering removal. These contours may include pits, grooves, adhesive residue, or other material.

Although some devices known in the art purport to adjust to the changing contours of the supporting surface, their use in the field is not satisfactory. The stripping blades of these prior art devices jump or slip out of operating position onto the top of the covering sought to be removed. As the speed of the stripping operation increases, the frequency of blade slippage over even minor contours increases.

When any of the above types of buildings are renovated, or when a new floor layer is required under any circumstances, it is first desired, if not absolutely required, to remove the pre-existing floor covering. The removal of the floor coverings is an arduous task because the existing floor coverings are securely fixed to the base surface such that the covering does not come unattached during its useful life.

Numerous types of physical attachment devices, such as thermosetting resin and epoxy resin, are employed to affix the floor cover to the underlying surface. Thus, when a floor covering is to be removed, the mechanism which adheres the floor covering to the underlying surface, usually an adhesive, must also be removed, in order for a clean surface to be presented for the application of the new floor covering. However, the strength of the adhesive, not only hinders removal of the adhesive, but often results in incomplete removal of the floor covering. Then, a portion of the floor covering remains adhered to the underlying surface by the adhesive, and result in a patchwork effect.

Human hand labor is the first, and most inefficient, means of removing floor coverings. Humans do not possess the strength necessary to remove floor coverings in most circumstances, even with hand tools. Hand operated or walk-behind machines are employed which grind or abrade the floor covering and connecting adhesive from the underlying surface.

However, these powered devices are dangerous. Not only can the high-speed vibrating portion of the mechanism can injure the worker, the particulate matter created by the grinding process is injurious to workers' respiratory system. Additionally, these hand-held or walk-behind devices do not completely remove the floor covering and underlying adhesive because the power source, which is limited by the relatively small size of the hand-held device, is insufficient for the task.

Larger machines are also known to be employed, in which the machine is powered by a hydraulic power source located at a distance. The cables associated with the hydraulic power source are cumbersome, and these machines, as with the hand-held machines, generally attempt to grind or abrade the floor covering and adhesive from the underlying floor surface, which results in the dissemination of unhealthful particulate matter. Furthermore, grinding or abrading is a time-consuming and inefficient method of removing the surface layer and underlying adhesive, because not only must the entire floor area be traveled (width times length), but the entire depth of the surface covering and adhesive must also be traversed.

While machines are generally known for scraping one or more surface layers from an underlying layer, such as road levelers and the like, these devices are entirely inappropriate for use on floor covering and underlying adhesives. These devices lack the combination of compact size, economy of use and efficiency of operation to be time and cost effective.

It is necessary from time to time to remove materials from floors, roofs and other surfaces. Examples of such materials include linoleum, vinyl, rubber, urethane, epoxy and other plastics, and asbestos or asbestos-containing building materials for flooring. Other materials include roofing and waterproofing materials, wood, and adhesive.

The removal of the material may be accomplished by hand-using hand-held blades, but such means of removal is expensive and difficult, and requires considerable effort on the part of the humans employed for the purpose. The considerable time required to remove the materials is of particular disadvantage when the material is removed from a store or other place of business, often requiring the business to remain closed during the process. In some circumstances, it may even be physically impossible to remove the materials by hand.

Machines are available for this purpose, but they have disadvantages. For example, many of the available machines do not offer sufficient power or speed to remove the more difficult materials from the surface. Some machines offer minimal or limited flexibility in the available angles of the removal blade. Such machines often require that the angle of the removal blade be adjusted manually, forcing the user to disembark from the machine to adjust the blade angle. This feature increases the expense, complexity and maintenance costs of the machine.

SUMMARY OF THE INVENTION

Among the many objectives of this invention is the provision of a vehicle small enough to maneuver within a building and powerful enough to scrape or remove a covering or coverings from a floor.

A further objective of this invention is the provision of a vehicle for removing at least one surface layer from a floor or the like.

Yet a further objective of this invention is the provision of a vehicle for forcing a blade member between the layer or layers to be removed with the application of sufficient force.

Also, an objective of this invention is the provision of a vehicle for forcing a blade member between the floor and the underlying layers with the application of sufficient force.

Another objective of this invention is the provision of a vehicle, which adjusts between a first machine transport position for movement of the vehicle from location to location, and second surface scraping position.

Yet another objective of this invention is the provision of a vehicle in which the relative weight over the blade of the vehicle can be altered to achieve the optimum desired mass balance of the vehicle.

Still another objective of this invention is the provision of a vehicle, in which the position of the portion of the vehicle supporting the blade can be altered with respect to the horizontal to provide a first degree of adjustment.

A further objective of this invention is the provision of a vehicle in which the blade can be angled with respect to horizontal to provide a second degree of adjustment.

A still further objective of this invention is the provision of a vehicle in which the angle of scraping of the blade with respect to the surface having a cover being removed therefrom can be precisely controlled.

Yet a further objective of this invention is the provision of a vehicle, in which the vehicle is mountable by a machine operator during use.

Also, an objective of this invention is the provision of a vehicle capable of being moved over a carpeted floor, with minimal damage thereto.

Another objective of this invention is the provision of a vehicle, which includes a blade capable of floating over the surface being scraped.

Yet another objective of this invention is the provision of a vehicle, which may receive a variety of attachments.

These and other objectives of the invention (which other objectives become clear by consideration of the specification, claims and drawings as a whole) are met by providing a self-propelled vehicle, having an adjustable blade being mounted thereon and being suitable for use in scraping a floor, with at least one optional attachment.

BRIEF DESCRIPTION OF THE DRAWINGS

FIG. 11 depicts a modification of the vehicle 100 of this invention having a caster wheel 300 for moving vehicle 100 around a job site.

FIG. 12 depicts a front perspective view of the mounting base 198 with the grinding mechanism 268 in place.

FIG. 13 depicts a front perspective view the mounting base 230 with a cutting wheel 600 in place.

Throughout the figures of the drawings, where the same part appears in more than one figure of the drawings, the same number is applied thereto.

DESCRIPTION OF THE PREFERRED EMBODIMENTS

Figure 1:
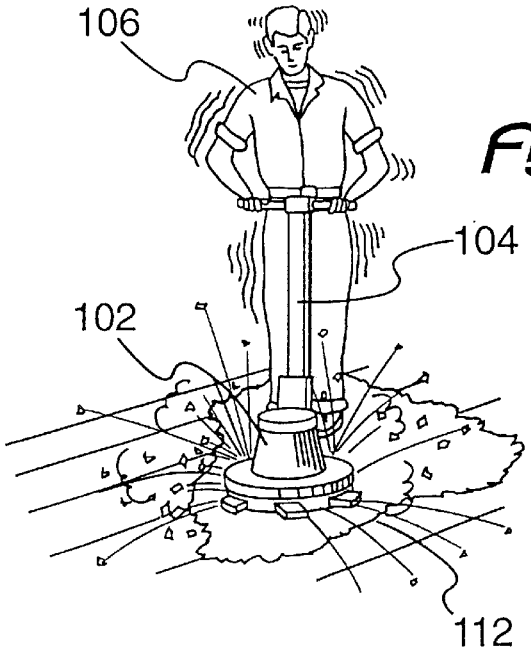
FIG. 1 depicts a perspective of a conventional, walk-behind floor stripping or scraping device 102 of the prior art handled by a walking operator 106 in a walk behind fashion.

The present invention generally pertains to a machine for removing at least one surface layer from a floor or the like. One or more surface layers, which are removable by the vehicle of the present invention include, but are not limited to, carpet, vinyl tile, vinyl sheet goods, hardwood flooring, hardwood parquet, elastomeric coatings, soft surface sports coating, marble, slate, grout, porcelain and epoxy resin. Surface coatings of the above types are generally found in, for example, homes, office buildings, stores, sports arenas, malls or similar structures.

The blade assembly is preferably narrower than the vehicle. This blade assembly can move slightly out of a horizontal plane and adjust to a floor. The blade assembly can also be rotated 180 degrees and thus have a minimum need for sharpening.

The vehicle can be based on a skid steer, whereby two wheels on one side will stop and the two wheels on the other side will drive the vehicle into a skidding turn. Alternatively, with the four wheels each being powered, the tractor can be maneuvered effectively, when used to scrape a floor. Whatever maneuverability for the vehicle is achieved, the joy stick arrangement provides for scraping manipulation with hydraulic control.

When the blade assembly is replaced with the caster, the vehicle becomes more maneuverable. A caster version or modification of a vehicle provides better maneuverability on carpet and the like. Also, such a caster permits the vehicle to be maneuvered without damage to the floor or a covering thereon.

This four-wheel drive vehicle can have its center of gravity situated between the four wheels. In this fashion, the weight of the vehicle is more evenly distributed and the scraping becomes more efficient. The scraper mounting device includes an angle top edge for support, which is pinned to the vehicle.

This angled top edge receives blade support. On the blade support is a top angled portion to receive the angled support on the vehicle. Extending from the blade support is a tubular member adapted to receive the blade tube. The blade assembly has a tube end and a clamping end. The scraping blade is secured in the clamping end.

In the tube end is a tube aperture adapted to receive a pin and lock the scraping blade in the blade support tube. The aperture in the blade support tube is slotted in order to provide for movement of the blade tube about the pin with the blade support tube. Such movement allows the blade to stay on the floor when the machine body and scraping device rotate oppositely about the horizontal plane.

Also, in this fashion, by pulling the pin, the blade can be turned over and the other side of the scraping blade can be used. By using the side to the scraping blade in reverse order in this fashion, the problem with a dull scraping blade can be avoided and blade life is extended.

There are three tubes on the front of the blade support. These three tubes permit the proper positioning of the blade assembly, and hence the blade. The left end tube and the right end tube permits scraping of the edge of the floor. The center tube permits scraping down the center. With this weighted distribution and flexibility provided by the slot in the tube, the scraping blade has flexibility and can achieve the desired result of scraping the floor in an efficient fashion.

Any suitable power source may be used for the vehicle of this invention, so long as the required dimensions, weight and power are not compromised. To that end, a gasoline-powered engine, an electrically powered engine, a natural gas-powered engine, a propane-powered engine, or other suitable power source may be used.

In a preferred form, a diesel engine is used on the vehicle. This diesel engine has a catalytic convertor connected thereto, which cuts the pollutants down to an extremely acceptable level from an Environmental Protection Agency standpoint and permits this vehicle to be used indoors. As above stated it is desired that the floor be concrete or extremely heavy duty.

While the scraping blade can be used on a standard wood floor in a house, there is a danger on the heaviness of the vehicle scraping the floor. However, the basic intent of this feature is for scraping floors in an industrial situation. The width of the vehicle permits it to go through most standard doorways, in order to enter conveniently, so that the scraping can be accomplished in a very efficient fashion.

In a preferred fashion, the scraping blade has an angle of about 20 to about 55 degrees relative to the front plate of the support plane. More preferred, the scraping blade has an angle of about 25 to about 50 degrees relative to the front plate of the support plane. Most preferred, the scraping blade has an angle of 30 to 45 degrees relative to the front plate of the support plane. With this angle, the scraping blade scrapes more efficiently on the floor. The scraping blade is lifted with a standard hydraulic assembly.

The scraping blade support can also support a grinder mechanism. There is a supplemental hydraulic connection for the grinder mechanism. This supplemental hydraulic mechanism operates the grinding wheels. With the grinding mechanism, the floor can be ground and stripped more easily, including, but not limited to, removal of the adhesive on the floor.

A particular type of grinder for this matter includes three slots. These slots receive the actual grinding mechanism. With the slots, the appropriate grinding mechanism can be inserted therein and provide for polishing. The slots can secure frictionally, mechanically or combinations thereof the grinder member within the slot to the grinding wheel. Preferably, there are three grinding wheels which are secured therein. In this fashion, the floor can be stripped very efficiently.

For the purpose of this invention, on all small tractors having a vehicle width sufficient to permit the vehicle to pass through a door is required. For example, on a vehicle with a width of 80 centimeters (30 inches) or less based on the doorway, a scraping blade can be mounted for scraping a floor covering off of a concrete floor preferably. It is also possible to use it on a wood floor. However, the floor must be extremely heavy duty and able to take substantial punishment. In this fashion, the covering on the floor can be removed and the appropriate cover can be placed.

While any blade width for the blade assembly is operable, certain parameters apply. The parameters vary based on the and are determinable based on this disclosure, with relation to the surface being scraped.

For a difficult surface, like tile, the blade assembly for the vehicle preferably has a width substantially less than the width of the vehicle. Such a narrow blade assembly provides for efficient scraping on an extremely difficult surface. For the difficult surface, a blade width of up to 50 percent of the vehicle width may be used. More preferably for the difficult surface, a blade width of up to 40 percent of the vehicle width may be used. Most preferably for the difficult surface, a blade width of up to 35 percent of the vehicle width may be used.

However, for less difficult surfaces, such as carpeting, a blade width of up to 200 percent of the vehicle width may be used. More preferably for the less difficult surface, a blade width of up to 175 percent of the vehicle width may be used. Most preferably for the less difficult surface, a blade width of up to 160 percent of the vehicle width may be used.

In FIG. 1 is depicted a standard walk behind scraping device 102. The walking operator 106 pushes the powered, rotating, scraping device 102 with a handle 104 and accomplishes a scraping of a floor 112. This requires great strength on the part of the operator 106 and provides difficulty in handling the scraping device 102.

Figure 2:
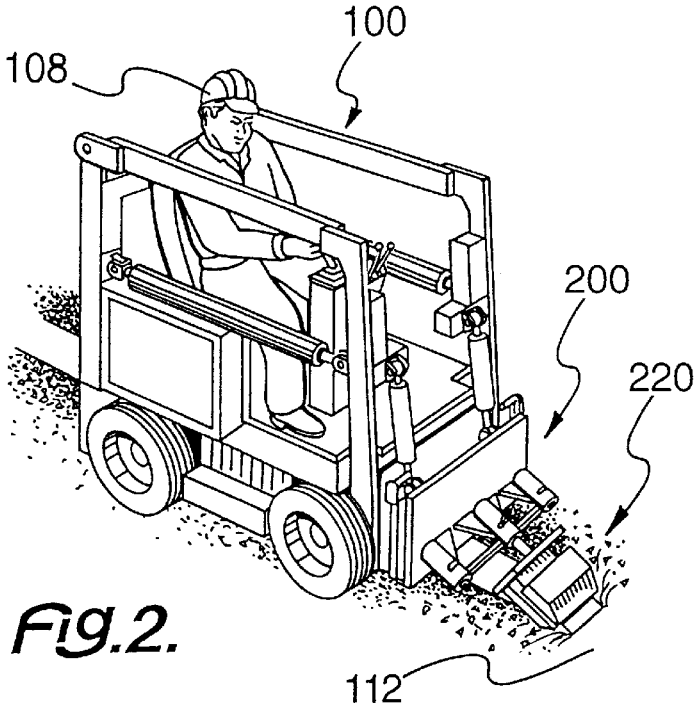
FIG. 2 depicts the floor stripping vehicle 100 of this invention, with a driving operator 108.
Figure 5:
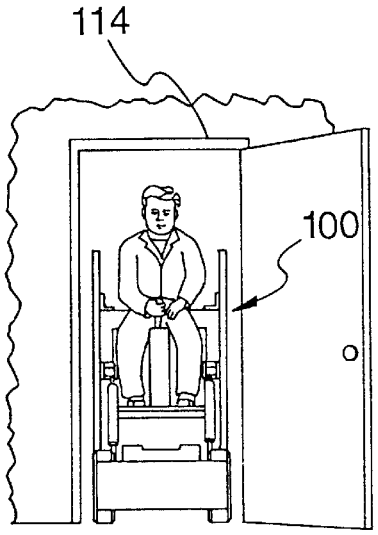
FIG. 5 depicts the floor cleaning vehicle 100 of this invention passing through a standard doorway 114.
Figure 6:
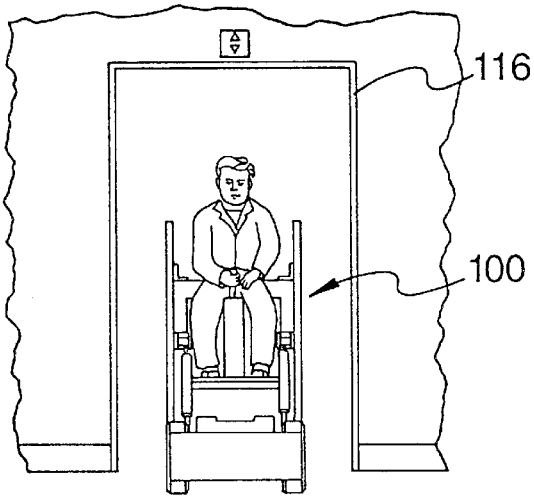
FIG. 6 depicts the floor cleaning vehicle 100 of this invention fitting into a standard passenger elevator 116.
Figure 16:
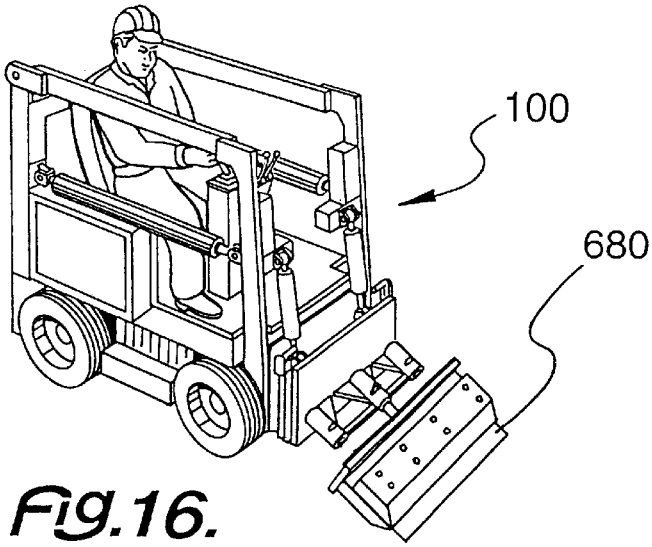
FIG. 16 depicts the floor stripping vehicle 100 of this invention, with a wide blade 680 in place.

In the vehicle 100 of FIG. 2, driving operator 108 uses the blade assembly 220 for scraping. The driving operator 108 rides on the vehicle 100, which is small enough to go through a doorway 114 (FIG. 5) or fit into a passenger elevator 116 (FIG. 16). This vehicle 100 has a flat scraping assembly 200 mounted on the front thereof, with a blade assembly 220.

Figure 3:
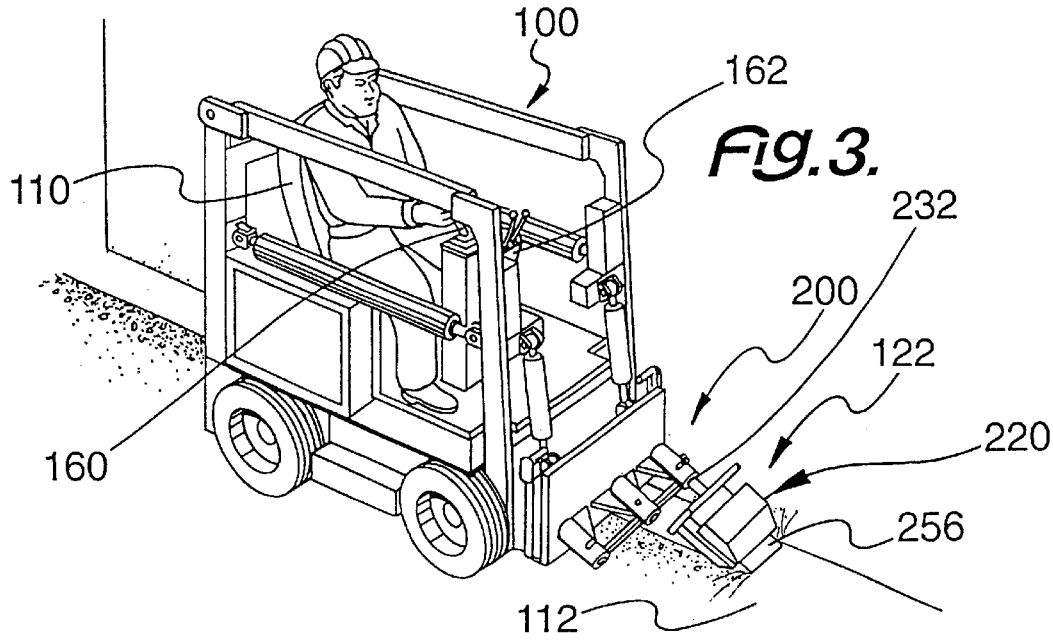
FIG. 3 depicts the floor stripping vehicle 100 of this invention in its edge cleaning mode 122.

With the addition of FIG. 3, the blade assembly 220 has the flexibility to move according to the floor 112 and be adjusted accordingly to scrape the edge of the floor 112 also. It is also possible to have a blade assembly 220 the full width of the vehicle 100. However, this narrower blade assembly 220 is preferred for more efficient scraping.

Thus, there are many advantages to this vehicle 100. The vehicle 100 is designed to be less a standard doorway in width. The vehicle 100 has a seat 110 mounted thereon. A joy stick assembly 160 controls the hydraulic system 162 and permits the blade 256 to be adjusted upwardly or downwardly.

The four wheel drive aspects of, the engine 402 permit the vehicle 100 to maneuver and avoid both the problems, occurring with a standard caster vehicle of the prior art. One of the main problems is the hanging up of the vehicle 100 on the material that has already been scraped up. In this fashion, the desired results of efficient scraping of an industrial type floor can be achieved.

Furthermore, FIG. 3 depicts how the blade assembly 220 can he placed in its edge cleaning mode 122 and thus can permit edge cleaning of floor 112. Blade assembly s 220 is secured in a different shaft receiving cylinder 232, which aligned slightly outside vehicle 100. In this manner the edge of floor 112 may be scraped.

Figure 4:
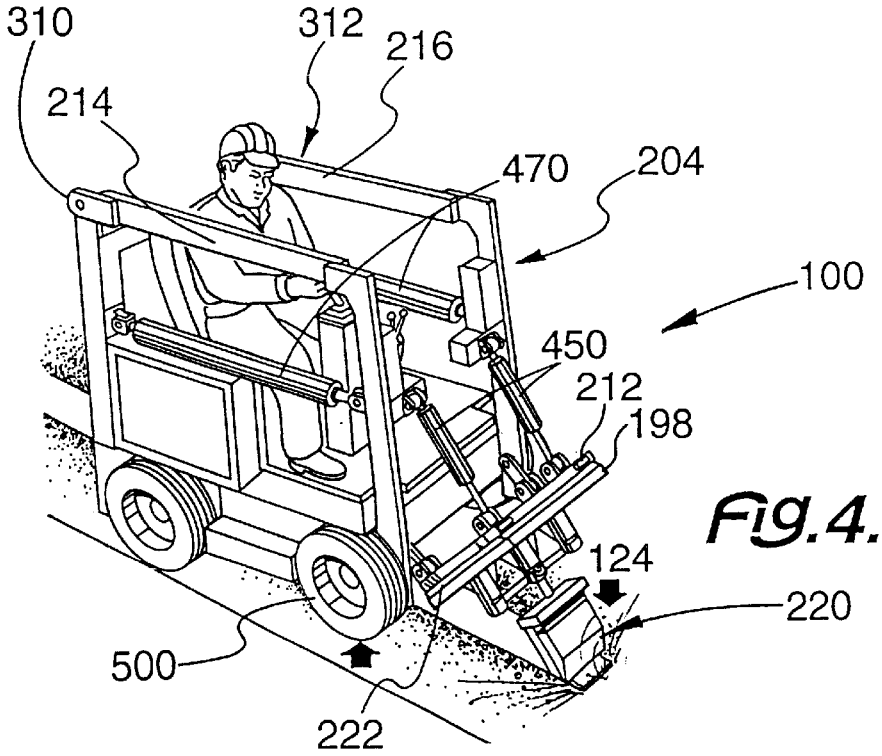
FIG. 4, depicts the floor cleaning vehicle 100 of this invention in a weighted pressure scraping position 124.

In FIG. 4, boom hinge 310 provides boom assembly 312 a movable connection hinged to vehicle 100 and provides hydraulic control of boom assembly 312 and flat scraping assembly 200. More particularly, boom assembly 312 has a first frame arm, 214 and a second frame arm 216 for primary support thereof.

By further consideration with FIG. 4, mount index cylinders 450 extend the scraping assembly 200 out and boom mass lift cylinders 470 position the scraping assembly 200, so that the burden of weight is transferred from the front wheels 500 of vehicle 100 to the blade assembly 220.

Weighted pressure scraping position 124 provides scrapping for extremely stubborn removal problems. With weight of the front wheels 500 being transferred to the blade assembly 220, heavy weight can be put on the blade assembly 220 for scraping purposes. In the blade assembly 220 is a tractor receiving base 222.

Figure 7:
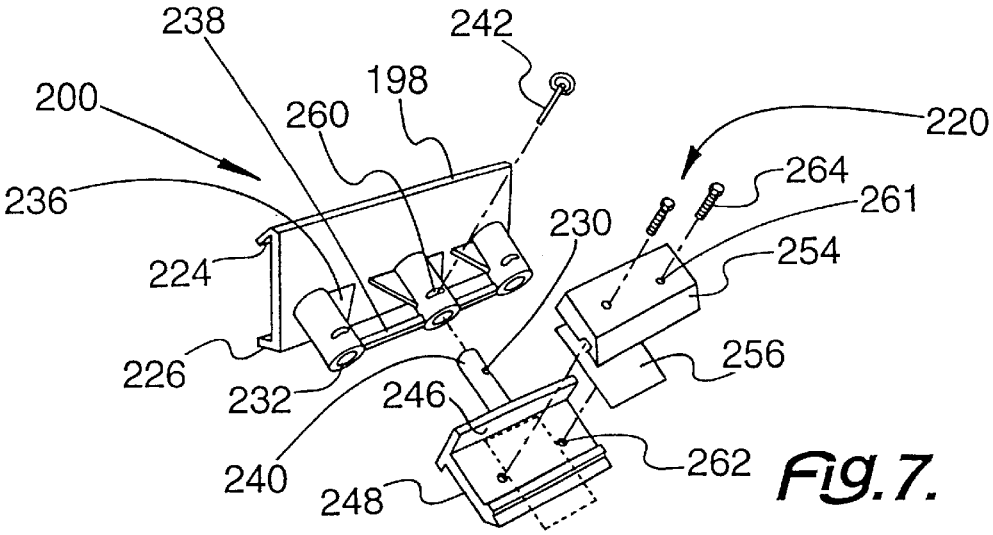
FIG. 7 depicts a perspective exploded view of the flat scraping assembly 200 of this invention.
Figure 8:
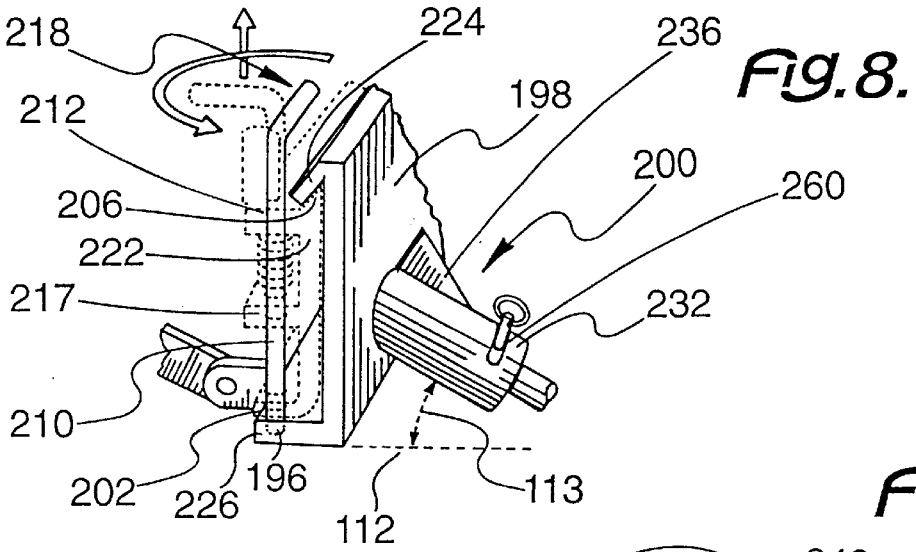
FIG. 8 depicts an assembled, perspective view of the scraping assembly 200 of this invention.
Figure 9:
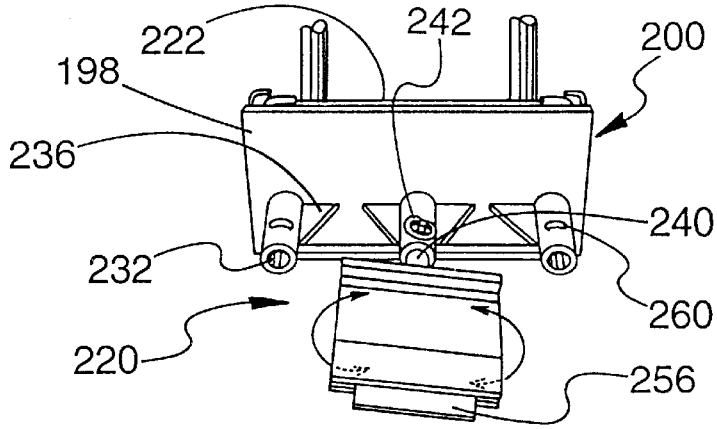
FIG. 9 depicts the rocking features of the blade assembly 220 for the scraping assembly 200 of this invention.

Adding FIG. 7, FIG. 8, and FIG. 9 to the consideration, on the mounting base 198 is an angled cradle grip 224 to support mounting of blade assembly 220 to the vehicle 100. Below the angled cradle grip 224 on tractor receiving base 222, is lower base 226, with a pin lock aperture 196 at each end thereof, positioned at a right angle to mounting base 198. The tractor receiving base 222 thus fits directly on to the vehicle 100 support.

Clearly in FIG. 7, shaft receiving cylinders 232 can be additionally supported and strengthened by buttress plates 236 being welded or otherwise secured thereto. Buttress plates 236 are also secured to mounting base 198. Buttress bar 238 is shown as welded or otherwise secured to all of shaft receiving cylinders 232. Clearly buttress bar 238 and buttress bar 236 can be used jointly or severally, depending on the support desired.

Figure 10:
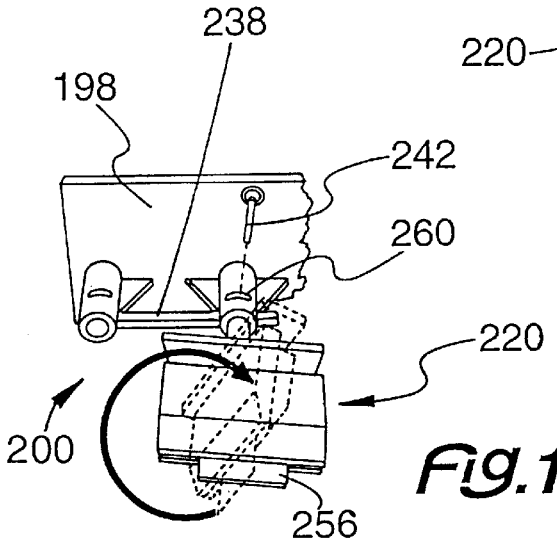
FIG. 10 depicts blade rotation procedure blade assembly 220 in order to sharpen blade 256 while mounted in the scraping assembly 200 on the vehicle 100 of this invention.

With FIG. 8, FIG. 9, and FIG. 10, mounted on the tractor receiving base 222, at an angle between thirty (30°) degrees and forty-five (45 ) degrees relative to the floor 112, are the shaft receiving cylinders 232. Any one of the shaft receiving cylinder 232 receives the blade holder shaft 240 of blade assembly 220. A blade lock pin 242 secures the blade holder shaft 240 within the shaft receiving cylinders 232. There is a pin receiving aperture 230 in the blade holder shaft 240.

The exploded view of FIG. 7 on the blade assembly 220 has blade 256 thereon. Blade 256 is longer in order for it to touch the blade face plate 246 and be supported on blade base 248 of blade assembly 220. Clamp plate 254 holds scraping blade 256 on blade base 248. Clamp bolts 264 fit into threaded apertures 262 in blade base 248, in order to form an assembly to hold blade 256 in position between clamp plate 254 and blade base 248 and mount the blade 256 on vehicle 100.

With the addition of FIG. 8, when plate pin 210 is rotated, it can be raised or lowered into pin receiving aperture 196 located in lower base 226. More particularly, scraping assembly 200 has mounting base 198 secured to receiving base 222. Receiving base 222 has an angled top edge 206 and a plate pin 210 located on each side of receiving plate 222. Plate pin 210 cooperates with angled top edge 206 in order to secure mounting base 198 to vehicle 100.

However, the pin receiving slot 260 on the shaft receiving cylinders 232 permits movement of the blade assembly 220, along with partial rotation of the blade assembly 220 within the shaft receiving cylinders 232. There is created an additional provision for flexibility and maneuverability of the blade assembly 220. Blade lock pin 242 passes through pin receiving slot 260 and cooperates with pin receiving aperture 230 to secure blade assembly 220 in a selected shaft receiving cylinder 232.

With pin receiving slot 260, blade lock pin 242 is permitted to move within the confines of slot 260. This movement permits blade assembly 220 and scraping blade 256 to have movement compensating for a rough floor 112, and provide for more efficient scraping.

Referring again to FIG. 7, the rest of the blade assembly 220 extends from the blade holder shaft 240. There is a blade face plate 252 secured perpendicular to the blade holder shaft 240. A blade base 248 is secured perpendicular to blade face plate 252, and thus parallel to blade holder shaft 240. The scraping blade 256 abuts the blade face plate 252. The clamp plate 254 for the blade 256 is bolted or otherwise secured to the blade base 248. In this fashion, the scraping blade 256 may be mounted in blade assembly 220, and then on vehicle 100.

Adding FIG. 10 to the consideration, it is also possible to rotate the blade holder assembly 220 in a half of a circle, that is 180 degrees. This can be done by using the blade lock pin 242 as a positioning device. This permits the blade 256 to be sharpened by use. Merely rotating blade assembly 220 in a 180-degree arc permits the other side of scraping blade 256 to be used, and make blade 256 more efficient. With this free rotation, blade 256 does not need to be sharpened or replaced as frequently. The flexibility is achieved, and the desired results can be obtained.

With further consideration of FIG. 8 and FIG. 10, the attachment of the scraping assembly 200 to vehicle 100 includes a tractor receiving base 222 with a pin lock 212 therein. The tractor receiving base 222 receives mounting base 198 at angled top edge 206. Pin receiving lower base 226 of mounting base 198 fits slidably over plate base 202 of tractor receiving base 222. Blade assembly pin 218 locks blade assembly 220 thereon.

The pin lock 212 receiver blade assembly pin 218, and passes behind and adjacent to the tractor base 222. Then pin lock 212 passes into the blade front support 230 and through aperture 217 and then into indentation 196 in lower base 226. In that fashion, the scraping blade 256 is properly secured.

As shown in FIG. 11, it is also possible to mount a caster wheel 300 in shaft receiving cylinders 232 instead of the blade assembly 220. This caster wheel 300 is pinned like the blade assembly 220. Mount index cylinder 450 extends the mounting base 198 out and boom mass lift cylinders 470 position the castor wheel 300, so that the burden of the weight shifts from the front wheels 500 of vehicle 100 to castor wheel 300. The castor wheel 300 permits easier movement of the vehicle 100 on delicate surfaces, for example a hardwood floor or carpeting.

The caster wheel 300, which provides the caster option actually goes right in where the blade assembly 220 fits, specifically into that center of the shaft receiving cylinders 232 and shaft lock pin 242 hold the caster wheel 300 just as the blade assembly 220 is held. More particularly, the center member of shaft receiving cylinders 232 receives caster wheel 300 and permits vehicle 100 to be brought into the building. Caster wheel 300 is especially useful for traversing carpeting or marble.

What caster wheel 300 does is make the vehicle 100 swing easily. It does not mess up carpeting and does not cause problems. It is just for transporting vehicle 100 over surfaces that are very fragile or very sensitive.

In FIG. 12, the blade assembly 220 can be replaced by a grinder assembly 550. The mounting system for the grinder assembly 550 is similar to the mounting system for the blade assembly 220. However, the grinder base plate 558 is perpendicular to the mounting base 198. Preferably it is supported by triangular grinding members 554 to buttress the matter and support grinding base plate 558 or grinding motors 552. Grinding stones or members 556 are rotatably mounted in the grinding plate 558. Hydraulic hoses 560 join grinder assembly 550 to the vehicle 100 and permit the grinding members 552 to be activated.

By the same token, in FIG. 13, a cutting wheel 600 can be mounted on lower base 226 instead of blade 256 and activated hydraulically in order to permit a cutting step to be carried out with this vehicle 100. The cutting wheel assembly 600 is standard implement adapted to fit vehicle 100. It has at least one cutting wheel 602 substantially perpendicular to lower base 226 and is mounted thereon in a standard fashion. Cutting wheel 600 may be powered hydraulically or in any other suitable fashion.

By combining FIG. 12 and FIG. 13, other implements besides cutting wheel 600, grinder assembly 550, long blade assembly 220, and adjustable blade holder 612, may be attached floor stripping vehicle 100. Such implements include, but are not limited to a bucket, a scarifier, a lift fork and a bucket with a grapple hook.

Figure 14:
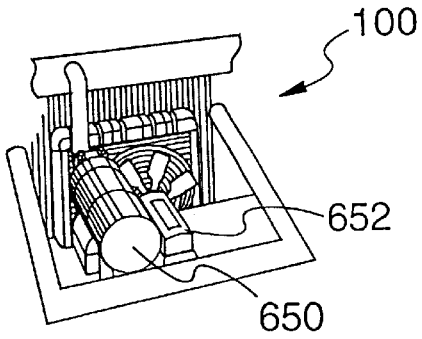
FIG. 14 depicts a catalytic converter 650 on a diesel engine 652 for the vehicle 100 of this invention.

As shown in FIG. 14, any engine is suitable. However, in view of the catalytic convertor 650 used with a diesel engine 652, the emissions from the diesel engine 652 are reduced. In that fashion, the desired results can be obtained in a very efficient manner. Not only is the diesel engine 652 very efficient, it can be used on the concrete floors and scrape the floors extremely efficiently.

Figure 15:
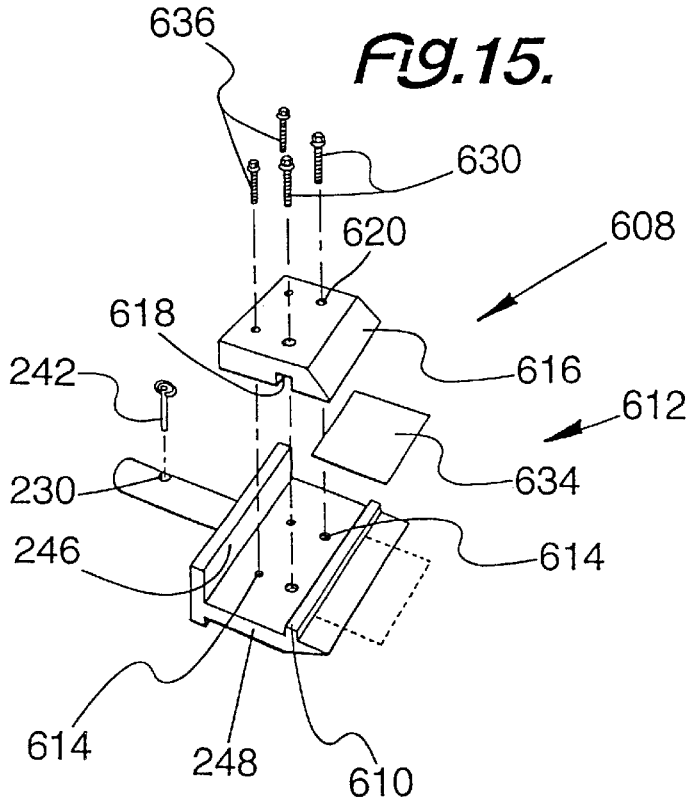
FIG. 15 depicts a perspective exploded view of the bar scraping assembly 608 of this invention.

In FIG. 15, the bar scraping assembly 608 is a modification of the flat scraping assembly 200 of FIG. 7. The blade base 248 of FIG. 7 includes a blade stop 610 in order to form adjustable blade holder 612. Between the blade face plate 246 and blade stop 610 are four threaded apertures 614 set in a preferably rectangular array. Two of apertures 614 may be used to adjust for blade thickness.

Cooperating with the adjustable blade holder 612, is adjustable clamp plate 616. Adjustable clamp plate 616 includes blade stop receiver 618. Blade stop receiver 618 is adapted to receive blade stop 610. Adjustable clamp plate 616 also includes four bolt apertures 620. Each of the bolt apertures 620 aligns with a threaded aperture 614.

In a preferred form, two of threaded apertures 614 are adjacent to blade stop 610 and receive hold down bolts 630 in order to lock short blade 634 between adjustable clamp plate 616 and blade base 248, and with short blade 634 being adjacent to or having contact with blade stop 610.

As further preferred form, angle spacer bolts 636 are adjacent to blade face plate 246. Angle spacer bolts 636 can either provide additional blade clamping or additional hold down blots 630. Clamping is achieve by angle spacer bolts 636 merely contacting blade base 248 and forcing the adjustable clamp plate upwardly adjacent to the blade face plate 246 and downwardly to clamp short blade 634.

Short blade 634 is advantageous due less material being required and a simplified changing procedure. Other advantages are available also. Short blade 634 and long scraping blade 256 must be formed expensive material to be durable. Less material with equal results due to blade stop 610 is a great advantage.

Referring now to FIG. 16, it become that large blade assembly 680 can be vehicle 100. Large blade assembly 680 can also be support in one, two or three of shaft receiving cylinders 232 by adding the appropriate number of blade holder shaft 240.

Large blade assembly 680 can have a width of 10 per cent to 150 percent of vehicle 100. More preferably, large blade assembly 680 can have a width of 20 per cent to 125 percent of the width of vehicle 100. Most preferable, large blade assembly 680 can have a width of 30 per cent to 105 percent of the width of vehicle 100. Large blade assembly 680 may have a structure similar to long blade assembly 220 or bar scraping assembly as desired.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to Letters Patent of the United States is:

1. A self-propelled vehicle being suitable for use in scraping at least one surface layer from a floor, comprising:

(a) an adjustable blade assembly being mounted on the vehicle;

(b) a catalytic converter being mounted on the vehicle;

(c) the catalytic converter permitting the vehicle to be operated within a building; and (d) the adjustable blade assembly having at least one mounting position relative to the vehicle;

(e) the adjustable blade assembly having at least a first rotated position and a second rotated position relative to the at least one mounting position;

(f) a scraper mounting device being mounted on the vehicle;

(g) the scraper mounting device including an angled top edge and a pin support assembly; and (h) the scraper mounting device being adapted to receive the adjustable blade assembly.

2. The self-propelled vehicle of claim 1 further, comprising:

(a) the adjustable blade assembly being narrower than the vehicle;

(b) the adjustable blade assembly having a scraping blade mounted therewith;

(c) the self-propelled vehicle having four wheels;

(d) a blade support attaching the blade assembly to the vehicle: and (e) the self-propelled vehicle having four wheel drive.

3. The self-propelled vehicle of claim 2, further comprising:

(a) the adjustable blade assembly being rotatable 180 degrees and remountable on the self-propelled vehicle;

(b) the self-propelled vehicle having a center of gravity substantially centrally situated between the four wheels of the vehicle; and (c) a scraper mounting device being connected to the vehicle.

4. The self-propelled vehicle of claim 3, further comprising:

(a) the scraper mounting device receiving the adjustable blade assembly; and (b) the self-propelled vehicle having power to each wheel of a four wheel set in order to provide maneuverability for the vehicle.

5. The self-propelled vehicle of claim 4, further comprising:

(a) the vehicle being based on a skid steer vehicle;

(b) the vehicle further including a joy stick for steering the vehicle; and (c) the vehicle being usable indoors.

6. The self-propelled vehicle of claim 5, further comprising:

(a) the vehicle receiving a blade assembly;

(b) the vehicle receiving a castor wheel assembly;

(c) the blade assembly scraping a floor; and (d) the castor wheel assembly moving the vehicle to a work site.

7. The self-propelled vehicle of claim 6, further comprising:

(a) the blade support having a bottom pin assembly;

(b) the blade support having a top angled portion;

(c) the top angled portion receiving the angled support on the vehicle; and (e) the bottom pin assembly and the top angled portion cooperating to mount the blade support on the vehicle.

8. The self-propelled vehicle of claim 7 further comprising:

(a) the blade support having at least one tubular member;

(b) the adjustable blade assembly having a tube and oppositely disposed from a clamping end;

(c) the tube end holding the blade assembly on the vehicle;

(d) the at least one tubular member receiving the adjustable blade assembly; and (e) the clamping end holding the scraping blade.

9. The self-propelled vehicle of claim 8 further comprising:

(a) the at least one tubular member including at least one edge tube adapted to receive the adjustable blade assembly in order to provide for scraping an edge of a floor; and (b) the scraping blade being flexible.

10. The self-propelled vehicle of claim 9 further comprising:

(a) the tube end having a tube aperture;

(b) the tube aperture being a slot in order to provide for flexibility about the pin and keep the blade from getting hung up during a scraping process;

(c) the tube aperture receiving a pin and locking the scraping blade assembly in the blade support tube; and (d)the vehicle having a catalytic converter in order to render the vehicle suitable for indoor use.

11. A scraping blade assembly for removing at least one covering on a floor comprising:

(a) a flexible blade being secured in a clamping device;

(b) the clamping device comprising a blade face plate and a blade base;

(c) the blade face plate adjoining the blade base;

(d) the flexible blade resting on the blade base and touching the blade face plate;

(e) a clamp plate being secured to the blade base in order to hold the scraping blade therebetween;

(f) a blade holder shaft extending from the blade face plate and oppositely disposed from the blade base;

(g) a pin receiving aperture being in the blade holder shaft; and (h) the pin receiving aperture being adapted to cooperate with the pin receiving slot in order to receive a holding pin and mount the blade assembly on the vehicle.

12. The scraping blade assembly of claim 11, further comprising;

(a) the blade base including a blade stop to contact the flexible blade;

(b) at least two threaded aperture being in the blade base between the blade face plate and blade stop;

(c) the least two threaded apertures supporting the clamp plate on the blade base with bolts;

(d) the clamp plate including a blade stop receiver;

(e) the blade stop receiver receiving the blade stop; and (f) the adjustable clamp plate including a bolt aperture to align with each of the at least two threaded apertures.

13. A self-propelled vehicle being suitable for use in scraping at least one surface layer from a floor, comprising:

(a) an adjustable blade assembly being mounted on the vehicle;

(b) a blade support being mounted on the vehicle;

(c) the adjustable blade assembly being removably secured to the blade support;

(d) the adjustable blade assembly having at least one mounting position relative to the vehicle;

(e) the blade support providing three tubes on the blade support;

(f) each of the three tubes permitting a position of the blade assembly;

(g) a blade holder shaft extending from the blade assembly; and (h) the blade holder shaft being receivable one of the three tubes as desired.

14. The vehicle of claim 13 is further comprising a caster wheel being received into a center tube of the three tubes.

15. The vehicle of claim 13 further comprising the blade assembly having a blade assembly width up to about 110 percent of a width of the vehicle.

16. The vehicle of claim 13 further comprising:

(a) the three tubes having a diameter on a common line;

(b) the three tubes including a central tube and a side tube on either side of the central tube; and (c) the side tube providing for an edge of a floor to be scraped.

17. The vehicle of claim 16 further comprising:

(a) the blade assembly lifting a pair of front tires on the vehicle;

(b) the blade assembly being rotatable within one of the three tubes; and (c) the scraping blade having an angle of 20 to 55 degrees relative to the blade support.

18. The vehicle of claim 16 further comprising the blade assembly being replaced with a device selected from the group consisting of a grinder mechanism, a cutting wheel, a lift bucket, a scarifier, a lift fork and a grapple hook bucket.

* * * * *